US005167067A

United States Patent [19]

Sundstedt et al.

[11] Patent Number: 5,167,067

[45] Date of Patent: Dec. 1, 1992

[54] METHOD OF MAKING A ROLL WITH A COMPOSITE ROLL RING OF CEMENTED CARBIDE AND CAST IRON

[75] Inventors: Gert I. S. Sundstedt, Strängnäs; Ingvar J. Carlsson, Johanneshov, both of Sweden

[73] Assignee: Sandvik AB, Sandviken, Sweden

[21] Appl. No.: 813,921

[22] Filed: Dec. 27, 1991

Related U.S. Application Data

[62] Division of Ser. No. 658,651, Feb. 21, 1991, Pat. No. 5,104,458, which is a division of Ser. No. 449,820, Dec. 13, 1989, Pat. No. 5,044,056.

[30] Foreign Application Priority Data

Dec. 13, 1988 [SE] Sweden ..... 8804503

[51] Int. Cl.[5] ..... B22F 3/00

[52] U.S. Cl. ..... 29/895.21; 29/895.2; 29/132

[58] Field of Search ..... 29/132, 895.2, 895.21; 148/3, 141, 148, 321, 324; 75/243; 428/564

[56] References Cited

U.S. PATENT DOCUMENTS 3,609,849 10/1971 Krol .
3,787,943 1/1974 Loqvist .
3,807,012 4/1974 Loqvist .
3,860,457 1/1975 Vourinen et al. .
3,997,370 12/1976 Horvath, Jr. et al. .
4,099,311 7/1978 Kark .
4,119,459 10/1978 Ekemar et al. .
5,044,056 9/1991 Sundstedt et al. .

FOREIGN PATENT DOCUMENTS 60-27407 2/1985 Japan .
3248482 12/1982 United Kingdom .

OTHER PUBLICATIONS

J. F. Janowak et al., "Approaching Austempered Ductile Iron Properties by Controlled Cooling in the Foundry", J. Heat Treating, American Society for Metals, vol. 4, No. 1, Jun. 1985, pp. 25-31.
Abstract for Swedish Patent Application 86-03987-2, filed Mar. 24, 1988.

*Primary Examiner*—P. W. Echols
*Assistant Examiner*—David P. Bryant
*Attorney, Agent, or Firm*—Burns, Doane, Swecker & Mathis

[57] ABSTRACT

The present invention discloses a roll for hot and/or cold rolling. The rolling track comprises one or several cemented carbide rings, which are cast into a casing made by an iron alloy. The cast alloy comprises a materially graphitic cast iron, which after the casting contains residual austenite. This residual austenite is at subsequent heat treatment or treatments partly or totally transformed under volume increase to mainly bainite with the aim of reducing or totally eliminating the differential shrinkage between the cast iron and the cemented carbide as a result from cooling after the casting.

1 Claim, 4 Drawing Sheets

1
2
3D
3D
4
5
6
7
8
9
A

METHOD OF MAKING A ROLL WITH A COMPOSITE ROLL RING OF CEMENTED CARBIDE AND CAST IRON

This application is a divisional of application Ser. No. 07/658,651, filed Feb. 21, 1991, now U.S Pat. No. 5,104,458, which is a divisional of application Ser. No. 449,820, filed Dec. 13, 1989, now U.S. Pat. No. 5,044,056, issued Sep. 3, 1991.

BACKGROUND OF THE INVENTION

The present invention relates to a composite roll ring, namely, a one-piece composite ring having a cast iron portion and a cemented carbide portion with a metallurgical bond therebetween, said cast iron having a carbon equivalent of from 2.5 to 6.0 and a microstructure predominantly of bainite, at least some of the bainite having been formed by the heat treatment of austenite. The roll ring may be mounted on a spindle with driving devices for transmitting torque from the spindle to the roll ring being located in the cast iron portion of the ring. In addition, methods for making the roll ring and a roll including at least one roll ring are disclosed.

The use of roll rings made of cemented carbide for hot or cold rolling has been hampered by the problem of the transmittal of torque from the driving spindle to the carbide roll rings without causing serious tensile stresses. Cemented carbides are brittle materials with limited tensile strengths and especially high notch sensitivity in inner corners such as keyway bottoms or other driving grooves, or at roots of driving lugs which are integral with the carbide ring. Use of such cemented carbide roll ring using conventional joints have proved unsatisfactory.

Another method proposed for the transmission of torque is by means of frictional forces at the bore surface of the carbide ring. However, radial force on the surface gives rise to tangential tensile stresses in the carbide rings with the maximum tensile stresses at the inner diameter. These tensile stresses are superimposed on other tensile stresses generated when the roll is in use generally leading to tensile stresses which are too high.

U.S. Pat. Nos. 3,787,943 and 3,807,012 disclose a method of making a composite roller for hot and cold rolling and the roller itself in which a ring of cemented carbide has a ferrous alloy such as steel cast about it. The composite ring is cooled such that the ferrous metal hub shrinks more than the cemented carbide ring thereby exerting compressive forces on the cemented carbide ring to hold it in place. Holes can be drilled in the hub so that an epoxy based resin can be inserted into the composite ring after shrinkage filling the holes formed by the shrinkage. No bonding between the cemented carbide ring and the ferrous body is disclosed.

However, during cooling from the casting temperature, the casing shrinks more than the carbide ring, hereby giving rise to inwardly directing forces on the carbide ring. These forces produce axially directed tensile stresses on the outer surface of a carbide ring, which tensile stresses act perpendicularly to microcracks generated in the roll surface during rolling. Under the influence of these perpendicularly directed tensile stresses, the microcracks propagate in depth which may cause roll breakage or the need for excessive dressing amounts. Both limit the total rolling capacity of the roll.

It is also known as disclosed in U.S. Pat. No. 3,609,849 to form composite roll rings which consist of a working part of cemented carbide in a casing of various metal or metal alloy powders which are then sintered about the carbide.

In this case, the casing materials are characterized either by low hardness or low yield strength. Otherwise, a cemented carbide, a brittle material, is used. Neither of these materials are particularly suitable for use in the necessary torque transmission couplings.

OBJECTS AND SUMMARY OF THE INVENTION

It is an object of this invention to obviate or substantially alleviate the deficiencies of the prior art.

It is also an object of this invention to provide a roll ring capable of being used on a spindle which roll ring combines the good wear properties of cemented carbide with inherent means for satisfactorily transmitting the rolling torque from the spindle to the roll ring and also attaching the roll ring on the spindle.

It is further an object of this invention to provide a method of forming such a roll ring and the roll in which the roll ring is included.

In one aspect of the present invention there is provided a roll ring comprising a graphitic cast iron body having a carbon equivalent of from 2.5 to 6.0 and a microstructure predominantly of bainite, at least some of the bainite having been formed by heat treatment of austenite, and a ring of cemented carbide on at least a portion of the outer surface of such said iron body, the cemented carbide being metallurgically bonded to said iron body.

In another aspect of the present invention there is provided a roll for hot or cold rolling comprising a spindle, at least one roll ring as set forth in the immediate preceding paragraph and means for transmitting torque from said spindle to the cast iron portion of the said roll ring.

In still further another aspect of the present invention there is provided the method for forming a roll ring comprising sintering a cemented carbide into a ring of predetermined size, casting iron about a portion of said sintered cemented carbide ring to form a composite body including a metallurgical bond between the cemented carbide and the cast iron, said cast iron having a microstructure comprising austenite and bainite and heat-treating the composite body to at least convert part of the austenite to bainite.

In yet still another aspect of the present invention, there is provided a method of forming a roll comprising attaching at least one roll ring as made by the method of the immediate preceding paragraph to a spindle with torque transmitting means posed between said spindle and the cast iron portion of said composite roll ring.

DESCRIPTION OF THE PREFERRED EMBODIMENTS

Figure 1A:
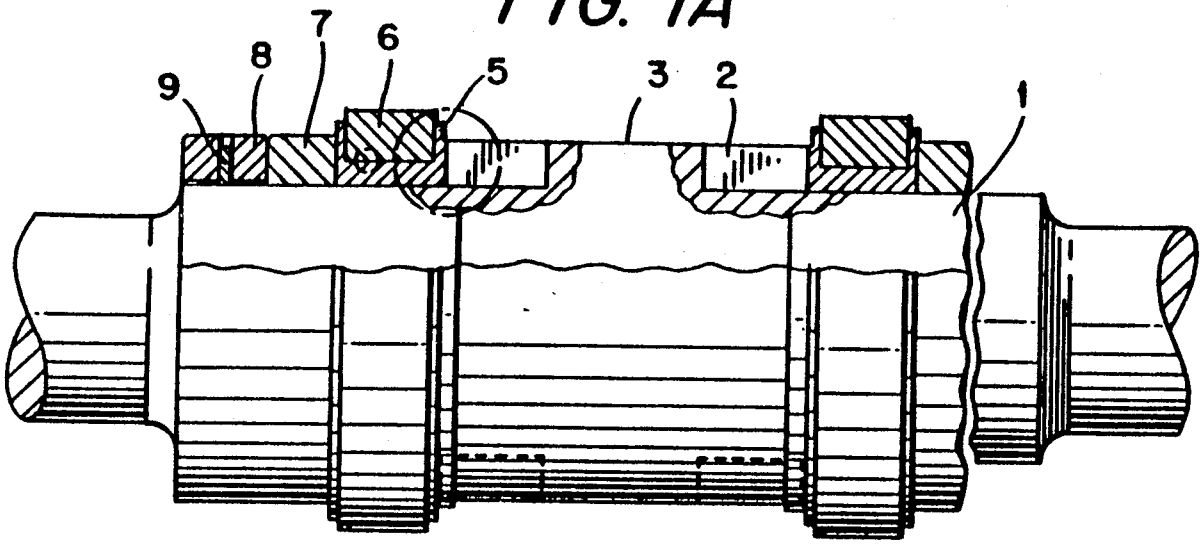
FIG. 1A is a schematic representation of a roll including the composition roll ring of the present invention.
Figure 1B:
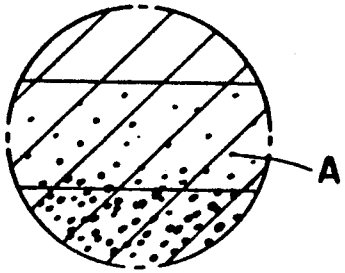
FIG. 1B is a schematic representation of a metallurgical cross-section of a portion of the roll ring of the present invention.
Figure 1C:
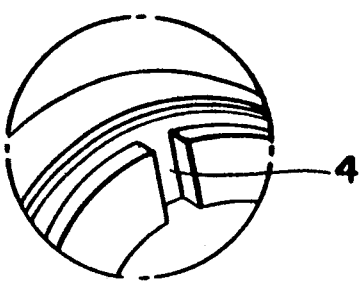
FIG. 1C is a representation of the portion of the roll ring of FIG. 1A shown as a dotted circle.

In principle, any grade of cemented carbide can be used in roll rings made according to the present invention. However, the difference in linear thermal expansion properties between ductile iron and cemented carbide, the latter having lower thermal expansion, increases with reduced binder phase content in the cemented carbide. In rolls for hot-rolling, cemented carbide grades with 15 or more percent by weight of the binder phase, said binder phase comprising cobalt, nickel and chromium in various combinations and amounts may be used and have been proven to be successful. Cobalt or cobalt-based alloys are the most common binder metals. The carbide phase of the cemented carbide can be any of the conventional cemented carbides with tungsten carbide generally being preferred The tungsten carbide can possibly also include one or more of the carbides of titanium, tantalum, niobium or other metals, but any conventional cemented carbide can also be used.

The composite roll ring of the present invention eliminates or substantially reduces the detrimental tensile stresses described in the aforesaid U.S. Pat. Nos. 3,787,943 and 3,807,012. This is achieved by casting the carbide into an essentially graphitic cast iron with its composition adjusted to provide a carbon equivalent, $C_{eqv.}$, as described in U.S. Pat. No. 4,119,459 which is herein incorporated by reference. In that patent, it is disclosed that the composition of the essentially graphitic cast iron is adjusted so that the carbon equivalent—i.e., the content of carbon and other constituent alloying elements equivalent to carbon having influence on the properties of the cast iron, is 2.5 to 6.0, preferably 3.5 to 5.0, weight percent. Because silicon and phosphorus are the elements which, besides carbon, have the greatest influence on the properties of cast iron, the carbon equivalent is determined according to the formula:

$$C_{eqv.} = \% C + 0.3 (\% Si + \% P)$$

The composition of the cast iron is also chosen with regard to the optimization of forming a metallurgical bond to the carbide, to its strength toughness and hardness (all necessary for the transmission of torque) and to its machinability. By addition of Fe-Si-Mg and/or Ni-Mg, the cast alloy has a magnesium content of from about 0.02–0.10, preferably 0.04–0.07, percent by weight. By inoculation with Fe-Si, the cast alloy has a silicon content of from about 1.9–2.8, preferably 2.1–2.5, percent by weight. Since both Mg and Si are well-known nodularizing agents, ductile iron is thereby obtained having dispersed spheroidal graphite with a hardness-toughness-strength balance which is well suited for its use in a roll ring. In heat-treated condition the Brinell hardness is 250–350. Further, the iron can be alloyed with austenite generating elements. Nickel and molybdenum are preferred in amounts of, for nickel, about 3–10, preferably about 4–8, percent by weight and, for molybdenum, in amounts of up to about 3, preferably 0.1–1.5, percent by weight. Other austenite-generating alloying elements, such as manganese and/or chromium may also be used, usually in combination with the nickel and/or molybdenum since the latter are the strongest austenite-generating elements. These other secondary austenite-generating alloying elements can be present in amounts of about 1 weight percent or less. The use of the austenite-generating alloying elements results in a certain amount of residual austenite, for example, from 5–30, preferably 10–25, most preferably 15–20, percent by weight after casting in the cast iron. The other constituents of the cast iron microstructure are essentially bainite and graphite nodules. Of the iron-based constituents, bainite is predominant after casting with the remainder being essentially austenite in amounts as described above.

By a heat treatment in the following described manner, in one or several steps, a suitable amount of the residual austenite can be transformed to bainite, resulting in a volumetric expansion of the cast iron portion since bainite has a greater volume than austenite. This volume increase can be adjusted so that the differential shrinkage which takes place in the composite roll ring during cooling from the casting temperature, can be partly or totally eliminated. While the specifics of the heat treatment will vary according to carbide grade, iron composition and roll application, the heat treatment generally includes first heating to and holding at a temperature of from about 800° to 1000° C., then cooling to and holding at a temperature of 400° to 550° C. and then cooling to room temperature. The first-mentioned temperature range results in increased toughness. When nickel and molybdenum are each added in the preferred amounts of from 3–6, most preferably 4–5, percent by weight for nickel and 0.5–1.5 percent by weight for molybdenum, the heat treatment can be made by heating to and holding the cast body at a temperature from 500° to 650° C. and cooling to room temperature.

The method of casting the carbide ring into the cast iron is accomplished generally using conventional casting techniques. However, in order to obtain the best metallurgical bond between the cemented carbide and the cast iron, the following processing parameters should be also observed. First, the iron in the cradle prior to casting should be maintained at a substantial temperature over and above the melting temperature of the iron. Usually, the iron is maintained at a temperature of at least about 300° to about 400° C. in excess of the melting temperature of the iron, preferably of at least about 325° to about 375° C. in excess of the melting temperature of the particular iron. In addition, the iron when melted should be adjusted in flow to melt a small surface layer of the carbide ring and achieve metallurgical bonding. Some of the material, particularly of the binder phase, of the cemented carbide may dissolve in the cast iron as is apparent to one skilled in the art. In addition, exothermal material such as the commercially available "FEEDEX" or other conventional exothermal material should be kept in a space above the roll ring space in the mold in order to keep a certain extra amount ot iron in the molten state after the roll ring portion of the mold has been filled. Further, it has been found best if the cast iron is inoculated with the spherodizing agents both in the cradle as well as in the mold.

The bond formed between the cemented carbide and the ductile iron in the cast composite roll ring can be checked by conventional ultrasonic methods.

The present composite roll ring generally received torque via conventional key joints, splines, clutches or similar known torque transmitting joints located in the considerably less notch-sensitive iron part of the roll ring. The torque is transmitted to the carbide ring via the metallurgical bond between the cemented carbide and the cast iron. In rolls for some rolling mills, only friction drive is allowed. However, even in that instance, the roll ring of the present invention can still be utilized.

In carbide roll rings, the separating force is counteracted by radial force only from the spindle against the bore of the carbide roll ring. As the carbide has a Young's modulus of two to three times that of steel or cast iron, the separating force will elastically deform the material separating the carbide roll ring in the bore, resulting in elastic deformation of the carbide ring and consequently, in tangential tensile stresses in the carbide ring with the maximum at the bore. In composite roll rings made according to the present invention, the cast iron on both sides of the carbide ring carries a part of the separating force which correspondingly reduces the tensile stresses.

The radial wall thickness of the carbide ring in composite roll rings according to the present invention can be reduced due to the above discussed lessening of the tensile stresses from the separating force. In addition, torque transmission by conventional key joints or similar constructions does not add to the tangential tensile stresses. Also, when driving by friction in the bore of composite roll rings, or when mounting with a press-fit between the composite roll ring in the spindle, the resulting tensile strength in the carbide ring is limited in relation to that of roll rings of solid carbide as in the prior art.

Compared to roll rings made of solid carbide with keyways or lugs in the ring faces, the carbide rings used in the composite roll ring made according to the present invention can be made more narrow by locating the driving devices in the cast iron part. Altogether, the composite roll ring made according to the present invention is characterized by a carbide ring having smaller dimensions than roll rings made of solid carbide which also lowers the cost. Furthermore, the carbide ring has to be machined on its outer surface only. This machining can often be done by turning and then preferably only on carbide grades containing 20 or more percent by weight of the binder phase. Machining of the bore, faces and driving devices which are made of cast iron which is more easily machined than cemented carbide also results in lower costs.

The grooves necessary for torque transmission can be made in the bore or on the faces of composite roll ring. More than several composite roll rings can be mounted on a roll body or spindle with journals in both ends with parts fitting in the grooves of the composite roll boring thereby transmitting the torque from the spindle either directly or via an intermediate sleeve. Some alternative designs are shown in FIGS. FIGS. 1A–4A. In these drawings, like numerals refer to like elements.

FIG. 1A shows a roll design where the torque is transmitted from the spindle 1 via keys 2, fastened in the middle part 3 of the spindle and fitting in the keyways 4 (FIG. 1C) of the composite roll ring, to the ductile iron part 5 of the composite roll ring and via the metallurgical bond A (FIG. 1B) to the carbide ring 6. The roll rings are fixed via the sleeve 7 by the nut 8 with a locking screw 9.

Figure 2A:
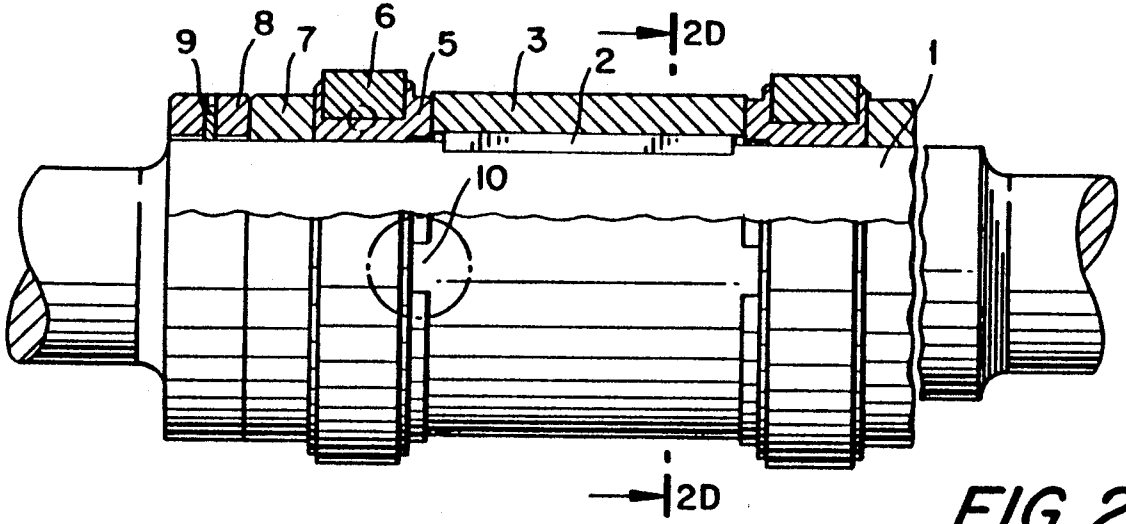
FIG. 2A is a schematic representation of another roll including the composite roll ring of the present invention.
Figure 2D:
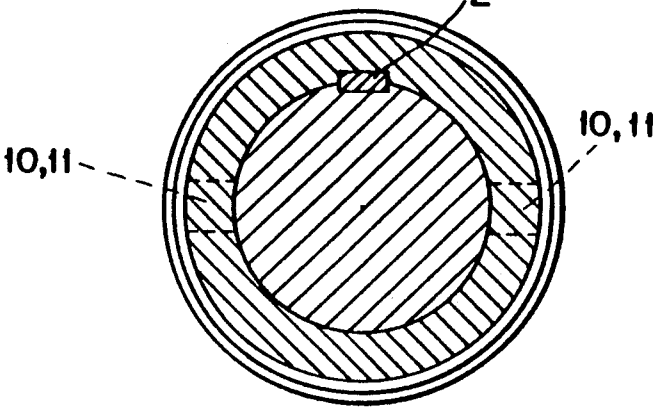
FIG. 2D is a cross-section of the roll ring of FIG. 2A taken along line 2D—2D.
Figure 2C:
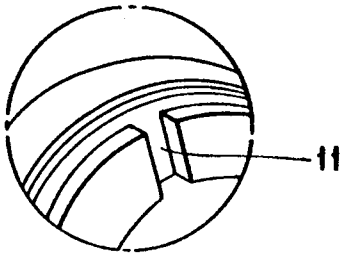
FIG. 2C is a representation of the portion of the roll ring of FIG. 2A shown as a dotted circle.
Figure 2B:
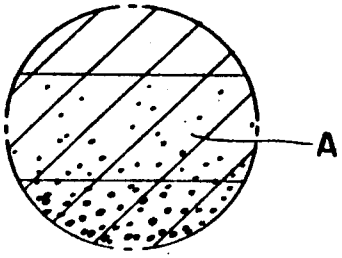
FIG. 2B is a schematic representation of a metallurgical cross-section of a portion of the roll ring of the present invention.

FIG. 2A shows a roll design where the torque is transmitted from the spindle 1 via the key 2 (FIG. 1D) to the sleeve 3, whose driving lugs 10 (FIG. 1D) fitting in the grooves 11 (FIG. 2C) transmit the torque to the ductile iron part 5 of the composite roll ring and via the metallurgical bond A (FIG. 2B) further to the carbide ring 6. The relative axial position of the roll rings is determined by the sleeve 3 and is fixed via the sleeve 7 by the nut 8 with a locking screw 9.

Figures 3A, 3B, 3C, 3D:
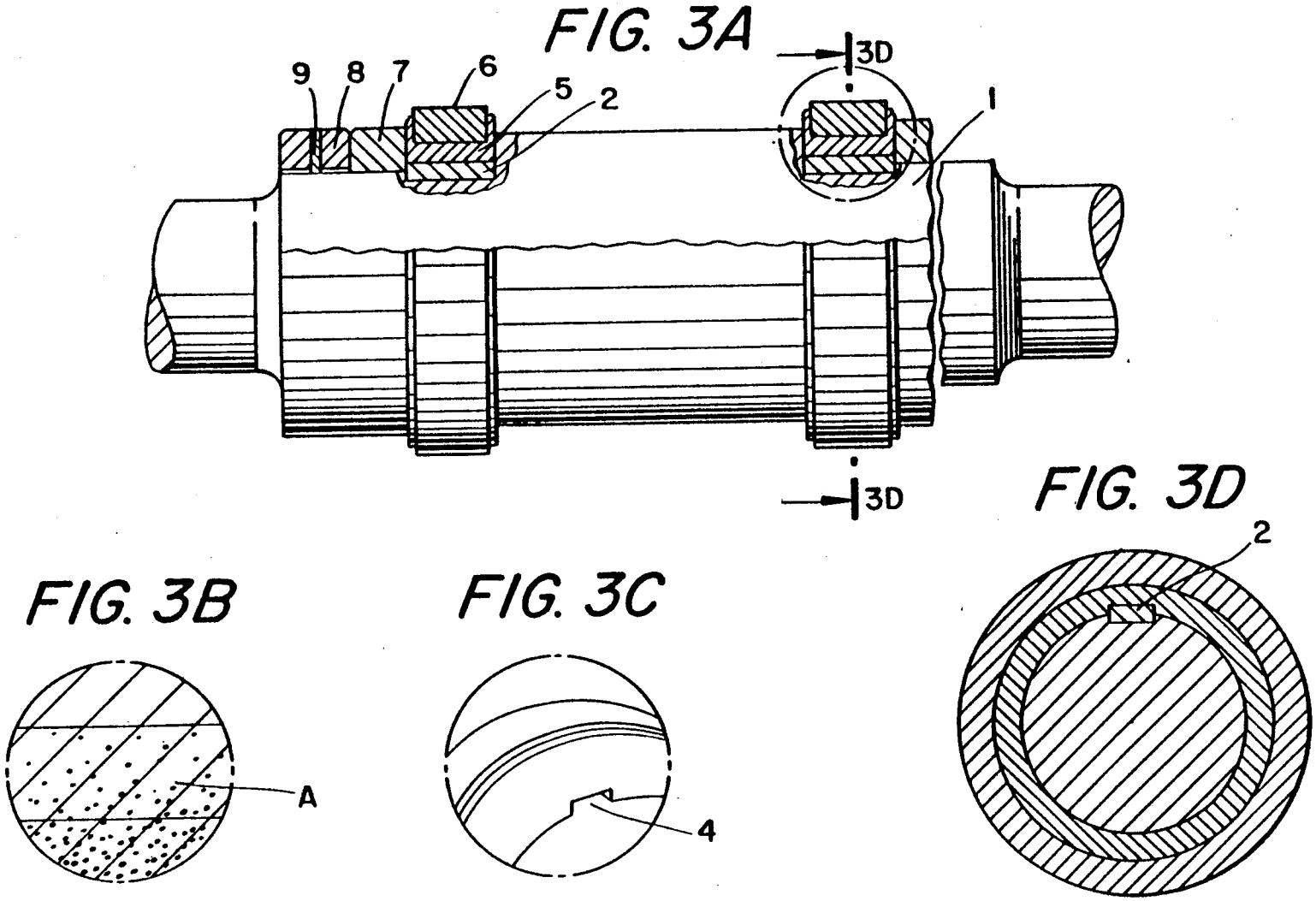
FIG. 3A is a schematic representation of another roll including the composite roll ring of the present invention.
FIG. 3B is a schematic representation of a metallurgical cross-section of a portion of the roll ring of the present invention.
FIG. 3C is a representation of the portion of the roll ring of FIG. 3A shown as a dotted circle.
FIG. 3D is a cross-section of the roll ring of FIG. 3A taken along line 3D—3D.

FIG. 3A shows a roll design where the torque is transmitted from the spindle 1 via the key 2 (FIG. 3D) in the keyway 4 (FIG. 3C) to the ductile iron part 5 of the composite roll ring and via the metallurgical bond A (FIG. 3B) further to the carbide ring 6. The roll rings are fixed via the sleeve 7 by the nut 8 with the locking screw 9.

Figure 4A:
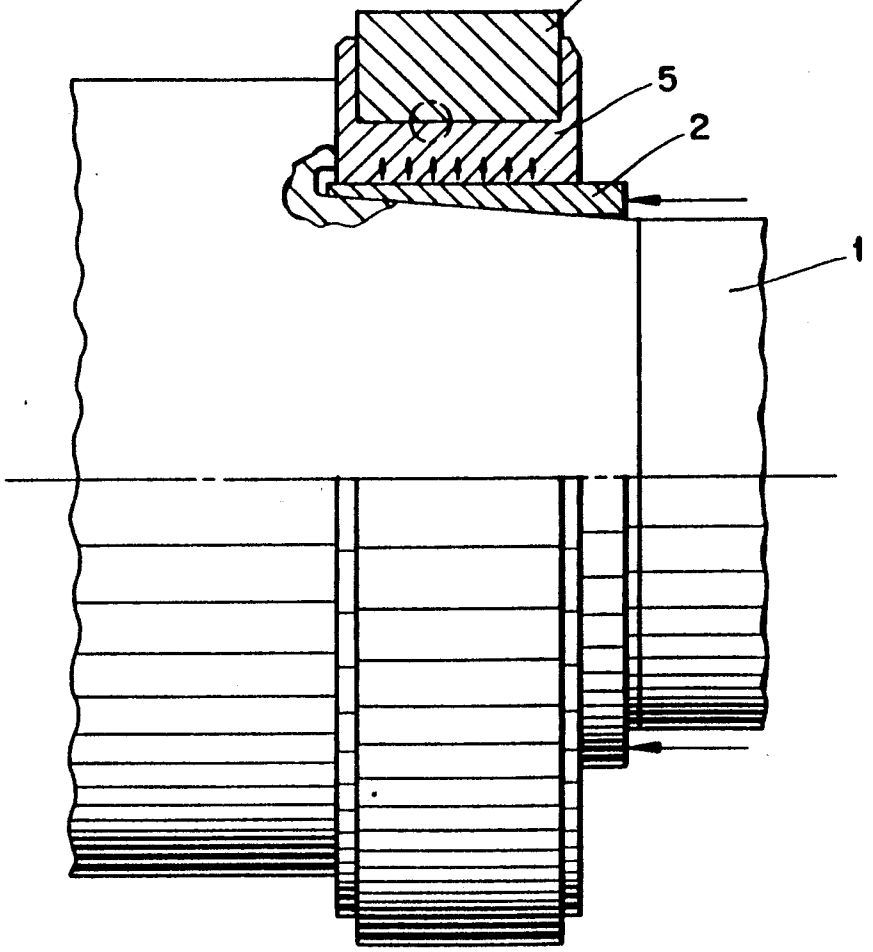
FIG. 4A is a schematic representation of another roll including the composite roll ring of the present invention.
Figure 4B:
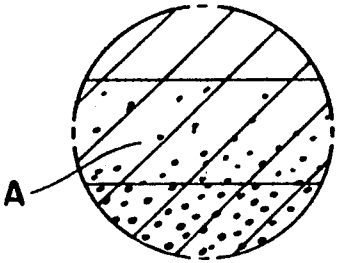
FIG. 4B is a schematic representation of a metallurgical cross-section of a portion of the roll ring of the present invention.

FIG. 4A stows a composite roll ring mounted on a free spindle end, i.e., the roll spindle has no bearing on one side of the roll ring. The&torque is transmitted by friction in the bore of the roll ring generated by the tapered sleeve 2 driven up the taper part of the spindle 1, to the ductile iron part 5 of the composite roll ring and via the metallurgical bond A (FIG. 4B) to the carbide ring 6.

The spindle can be made of any conventional material such as steel. One of the advantages of the present invention is that the spindle can be re-used since the working portion of the roll is a composite roll ring of the present invention.

Composite roll rings with carbide rings cast into ductile iron have been tested in finishing and intermediate rod mills, mounted on roll bodies with journals in both ends as well as on free spindle ends. They have also been tested as rolls for rolling reinforcement bars and tubes and as pinch rollers. Their performance has been in good agreement with the experience of carbide hot rolls gained since 1965. Carbide rings in the diameter range of 100–500 mm, preferably 200–450 mm, and the placement of the driving devices in the ductile iron open up utilization also in bar mills. Carbide rings with diameters up to 500 mm make possible utilization in cold rolling mills and in other roll applications.

The invention is additionally illustrated in connection with the following Example which is to be considered as illustrative of the present invention. It should be understood, however, that the invention is not limited to the specific details of the Example.

EXAMPLE

A sintered cemented carbide ring containing 70% WC in a binder phase consisting of 13% Co., 15% Ni and 2% Cr was blasted to clean its surface from any adhering materials. The outer diameter of the ring was 340 mm, the inner diameter 270 mm and its width 85 mm. A ring of sand was formed around the carbide ring and it was then placed in a bottom flask of a mold with suitable shape and dimensions and provided with the necessary channels and an overflow box for the molten iron. A ring of an exothermic material (FEEDEX) was placed in the top flask of the mold and the two flasks were put together and firmly locked.

Molten iron at a temperature of 1550° C. (approximately 350° C. above its melting point) and with a composition (in weight percent) of 3.7 C, 2.3 Si, 0.3 Mn, 5.4 Ni, 0.2 Mo, 0.05 Mg, and the balance Fe, was first inoculated in the cradle and then inoculated in the mold using inoculants of Fe-Si-Mg. The molten iron was then poured into the mold in an amount and at a flow rate such that a suitable melting of the cemented carbide surface was obtained. When the iron had risen to the exothermic material, the latter started to burn adding heat to the iron. The mold was cooled slowly to room temperature after which the roll was removed from the mold, excessive iron cut off and the roll cleaned. The quality of the metallurgical bond which had been formed between the cemented carbide and the cast iron as well as the absence cf flaws in the iron was checked by ultrasonic methods. The cast iron microstructure contained about 20% (by weight) austenite, remainder essentially bainite and nodular graphite.

The roll was then heat-treated to transform at least part of the about 20% austenite to bainite by heating to 900° C. and keeping at that temperature for six hours, then lowering the temperature to 450° C. and keeping there for four hours before cooling to room temperature. Finally, the roll was machined by turning to final shape and dimension viz. inner diameter of the bore 255 mm and width 120 mm.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

We claim:

1. A method of making a roll comprising the following steps:

forming a composite roll ring by sintering a cemented carbide into a ring of predetermined size, casting iron about a portion of said sintered carbide ring to form a composite body including a metallurgical bond between the cemented carbide and the cast iron, said cast iron having a microstructure comprising austenite and bainite, and heat-treating the composite body to convert at least part of the austenite to bainite, the differential shrinkage during cooling after casting between the cast iron body and the ring of cemented carbide being at least partly eliminated by the transformation of austenite to bainite; and attaching said composite roll ring to a spindle with torque transmitting means interposed between said spindle and the cast iron portion of said composite roll ring.

* * * * *